United States Patent [19]

Remberg et al.

[11] 4,177,003

[45] Dec. 4, 1979

[54] INSTALLATION FOR CENTERING THE INNER HOUSING OF A STEAM TURBINE

[75] Inventors: Axel Remberg; Willi Triesch, both of Mülheim, Fed. Rep. of Germany

[73] Assignee: Kraftwerk Union Aktiengesellschaft, Mülheim, Fed. Rep. of Germany

[21] Appl. No.: 822,797

[22] Filed: Aug. 8, 1977

[30] Foreign Application Priority Data

Aug. 10, 1976 [DE] Fed. Rep. of Germany ..... 2635980

[51] Int. Cl.[2] ..... F01D 25/26

[52] U.S. Cl. ..... 415/108; 415/144; 415/219 R

[58] Field of Search ..... 415/219 R, 201, 168, 415/108, 144; 60/677, 678, 39.31

[56] References Cited

U.S. PATENT DOCUMENTS

| | | | |
|---|---|---|---|
| 1,325,135 | 12/1919 | Baumann | 415/219 R |
| 3,592,557 | 7/1971 | Haas et al. | 415/108 |
| 3,937,589 | 2/1976 | Remberg | 415/219 R |

FOREIGN PATENT DOCUMENTS

| | | | |
|---|---|---|---|
| 570366 | 1/1933 | Fed. Rep. of Germany | 60/677 |
| 1010072 | 6/1957 | Fed. Rep. of Germany | 415/108 |
| 341305 | 1/1931 | United Kingdom | 415/201 |
| 428112 | 5/1975 | U.S.S.R. | 415/219 R |

*Primary Examiner*—William L. Freeh
*Assistant Examiner*—Thomas I. Ross
*Attorney, Agent, or Firm*—Herbert L. Lerner

[57] ABSTRACT

Installation for centering, in an outer housing, an inner housing of a steam turbine having an extraction interstage including a tubular shaped portion formed on the inner housing and communicating with the extraction interstage, the outer housing having a wall formed with a passageway wherein the tubular shaped portion is received, an extraction connecting pipe disposed on the outer housing over the passageway thereof, the extraction connecting pipe having sealing surfaces engaging with corresponding sealing surfaces formed on the wall of the outer housing, the mutually engaging sealing surface being disposd eccentrically to the passageway and to the tubular shaped portion, the tubular shaped portion having a projection with lateral flanks extending therefrom and engaging with clearance in a corresponding lateral recess formed in the wall of the outer housing, and key means disposed in the clearance between the lateral flanks of the projecton and the wall of the outer housing for centering the inner housing in the outer housing.

4 Claims, 2 Drawing Figures

INSTALLATION FOR CENTERING THE INNER HOUSING OF A STEAM TURBINE

Figure 1:
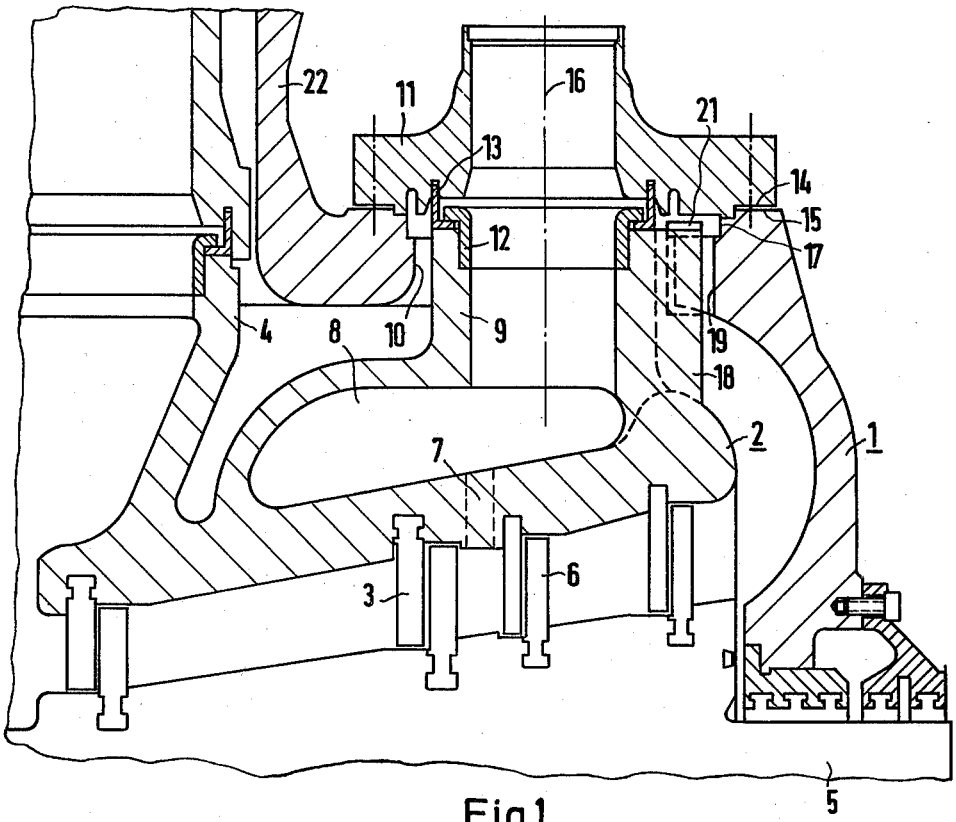

The invention relates to an installation for centering the inner housing of a steam turbine within the outer housing thereof, the turbine having a steam extraction interstage or intermediate steam bleeding location.

A turbine of the foregoing general type is known, for example, from German Petty Patent DT-Gbm No. 1 701 464. The centering of the inner housing in the outer housing is effected, as has been conventional heretofore, by means of sliding blocks as well as eccentric bushings or sleeves and fixing or guide bolts. Such a centering operation is at once very costly and requires a relatively large axial structural length. Moreover, several cumulative tolerances which can cause inaccurate centering, are produced thereby.

It is accordingly an object of the invention to provide an installation for centering the inner housing of a steam turbine wherein the centering is effected with slight play or clearance and is readily accessible from the outside.

With the foregoing and other objects in view, there is provided, in accordance with the invention, an installation for centering, in an outer housing, an inner housing of a steam turbine having an extraction interstage comprising a tubular shaped portion formed on the inner housing and communicating with the extraction interstage, the outer housing having a wall formed with a passageway wherein the tubular shaped portion is received, an extraction connecting pipe disposed on the outer housing over the passageway thereof, the extraction connecting pipe having sealing surfaces engaging with corresponding sealing surfaces formed on the wall of the outer housing, the mutually engaging sealing surfaces being disposed eccentrically to the passageway and to the tubular shaped portion, the tubular shaped portion having a projection with lateral flanks extending therefrom and engaging with clearance in a corresponding lateral recess formed in the wall of the outer housing, and key means disposed in the clearance between the lateral flanks of the projection and the wall of the outer housing for centering the inner housing in the outer housing.

In accordance with another feature of the invention, the key means comprise respective parallel keys disposed on opposite sides of the projection in the clearance between the lateral flanks of the projection and the outer housing wall.

In accordance with a further feature of the invention, the passageway formed in the outer housing has an upper region thereof disposed above the tubular shaped portion of the inner housing and eccentrically to the passageway so that the parallel keys are accessible from the outside of the turbine.

Through this eccentric installation of the sealing surfaces for the connecting pipe to the extraction interstage and the eccentric disposition of the passageway opening resulting therefrom, a space accessible from the outside is created wherein simplified centering of the inner housing is made possible.

Although the invention is illustrated and described herein as embodied in installation for centering the inner housing of a steam turbine, it is nevertheless not intended to be limited to the details shown, since various modifications and structural changes may be made therein without departing from the spirit of the invention and within the scope and range of equivalents of the claims.

Figure 2:
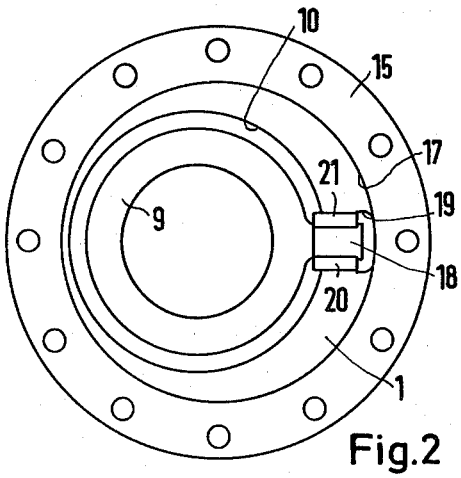

The construction and method of the invention, however, together with additional objects and advantages thereof will be best understood from the following description of specific embodiments when read in connection with the accompanying drawings, in which:

FIG. 1 is a fragmentary longitudinal sectional view of the upper half of a flow of a steam turbine in vicinity of the bleeder interstage or extraction point thereof; and FIG. 2 is a top plan view of the outer housing of the steam turbine in vicinity of a passageway for the bleeder interstage or extraction point formed in the housing.

Referring now to the drawing and first, particularly, to FIG. 1 thereof, there is shown in longitudinal sectional view, for example, a double-flow medium-pressure partial turbine, which includes an inner housing 2 with guide vanes 3 and with a concentric steam supply system 4, disposed within an outer housing 1 which surrounds a rotor 5 provided with rotor blades 6. The inner housing 2 has diagrammatically indicated extraction or bleeder holes or bores 7 which terminate in or communicate with an annular channel 8 formed in the inner housing 2. To remove the extracted steam, the inner housing 2 is formed with a tubular shaped portion 9 leaving the annular chamber 8 and extending to a passageway opening 10 provided in the outer housing 1. A connecting pipe or joint 11 is seated from the outside onto the opening 10 and is connected through angle rings 12 and 13 sealingly with the inner-housing shaped portion 9.

In order to permit a simplified centering of the inner housing 2, the following measures are taken in accordance with the invention of the instant application. The sealing surfaces 14 of the connecting pipe 11 and the sealing surfaces 15 of the outer housing 1, located opposite thereto, are disposed eccentrically to the central axis of the connecting pipe 11 and the shaped portion 9. In a similar manner, the upper region 17 of the passageway opening 10 is eccentrically apertured or cut out. A result thereof, as is apparent from the plan view of the sealing surfaces 15 and the inner housing-shaped portion 9, with the connecting pipe 11 removed, shown in FIG. 2, is the formation of a space adjacent the shaped portion 9 that is freely accessible from above, the space being utilizable for centering the inner housing 2. For this purpose, the inner-housing shaped portion 9 is provided with a lateral extension 18 which engages in a corresponding recess 19 formed in the outer housing 1 at the inner periphery of the passageway opening 10. Between the lateral flanks of this extension 18 and the corresponding lateral limiting surfaces defining the recess 19 in the outer housing 1, parallel keys 20 and 21 are inserted for accurate centering. By means of this extension 18 and the parallel keys 20 and 21, a simple and exact centering with slight play of the inner housing 2, that is readily accessible from the outside, is possible.

This centering requires, moreover, only little axial structural length so that a greater amount of axial space for steam inflows is available at the turbine and it is possible, therefore, to change from the heretofore conventional four steam in-flows to the two steam in-flows 22.

The centering is advantageously effected with similar construction at the other end of the two-flow turbine, a feature which is not illustrated in the drawing.

We claim:

1. Installation for centering, in an outer housing, an inner housing of a steam turbine having an extraction interstage comprising a tubular shaped portion formed on the inner housing and communicating with the extraction interstage, the outer housing having a wall formed with a passageway wherein said tubular shaped portion is received, an extraction connecting pipe disposed on the outer housing over said passageway thereof, said extraction connecting pipe having sealing surfaces engaging with corresponding sealing surfaces formed on said wall of the outer housing, the mutually engaging sealing surfaces being disposed eccentrically to said passageway and to said tubular shaped portion, said tubular shaped portion having a projection with lateral flanks extending therefrom and engaging with clearance in a corresponding lateral recess formed in said wall of the outer housing, and key means disposed in the clearance between said lateral flanks of said projection and said wall of the outer housing for centering the inner housing in the outer housing.

2. Installation according to claim 1 wherein said key means comprise respective parallel keys disposed on opposite sides of said projection in said clearance between said lateral flanks of said projection and said outer-housing wall.

3. Installation according to claim 2 wherein said passageway formed in the outer housing has an upper region thereof disposed above said tubular shaped portion of said inner housing and eccentrically to said passageway so that said parallel keys are accessible from the outside of the turbine.

4. Installation according to claim 1 wherein said mutually engaging sealing surfaces extend in radial direction of said housings and connecting pipe.

* * * * *